US005706746A

United States Patent [19]

Zeller

[11] Patent Number: 5,706,746

[45] Date of Patent: Jan. 13, 1998

[54] NEEDLE DRIVE FOR A MULTI-NEEDLE STITCHING MACHINE

[75] Inventor: Hans Zeller, Rebstein, Switzerland

[73] Assignee: Gateway (Textiles) Limited, Essex, United Kingdom

[21] Appl. No.: 565,827

[22] Filed: Dec. 1, 1995

[30] Foreign Application Priority Data

Dec. 14, 1994 [CH] Switzerland ..... 03787/94

[51] Int. Cl.$^6$ ..... D05B 69/00

[52] U.S. Cl. ..... 112/221; 112/163

[58] Field of Search ..... 112/220, 221, 112/80.4, 80.42, 163, 167, 165

[56] References Cited

U.S. PATENT DOCUMENTS

| | | | |
|---|---|---|---|
| 247,312 | 9/1881 | Coles | 112/221 |
| 3,450,081 | 6/1969 | Rabinow | 112/221 |
| 3,653,346 | 4/1972 | Parsons | 112/221 X |
| 3,665,873 | 5/1972 | Wittler . | |
| 4,190,006 | 2/1980 | Mellor | 112/221 X |
| 4,616,585 | 10/1986 | Marcandalli | 112/221 |

FOREIGN PATENT DOCUMENTS 2673205 8/1992 France .

*Primary Examiner*—Paul C. Lewis
*Attorney, Agent, or Firm*—Edwin D. Schindler

[57] ABSTRACT

A needle drive for a multi-needle stitching machine is provided, having a needle bar supporting needles, which is suspended on pairs of elbow joint levers. The elbow joint levers are engaged by a common push rod, which is movable back and forth by a drive. The needle bar is supported on vertical guides and is moved up and down by the pushing movements of the push rod. The needles of the stitching machine reach the lower point of reversal when the elbow joint levers are completely stretched, that is, when the elbow joint levers are disposed parallel with each other. In this manner, the lower point of reversal is clearly determined, and remains the same, irrespective of whether the lift of the push rod is increased or decreased in order to adjust the lifting of the needles from the sewing material.

12 Claims, 4 Drawing Sheets

NEEDLE DRIVE FOR A MULTI-NEEDLE STITCHING MACHINE

BACKGROUND OF INVENTION

1. Technical Field of the Invention

The present invention relates, generally, to a needle drive for a multi-needle stitching machine.

More particularly, the present invention relates to a needle drive for a multi-needle stitching machine, with a needle bar supported on vertical guides, by which the needles mounted on the needle bar are drivable. The needle bar of the invention is supported by a pair of elbow joint levers and the elbow joints of the cooperating elbow joint levers are connected with each other by a push rod, which is movable back and forth, transversely, to the direction of the needle lift by a drive.

2. Description of the Prior Art

Needle drives known to the state of the art are used, for example, on multi-needle stitching machines for quilting mattress overlays and have a great number of needles arranged next to each other, and one after another, in any desired configuration. Such needles are synchronously introduced into the sewing machine by a common drive and guided out of such material after the lower thread has been received by the upper thread; the latter being guided by the needle. So that sewing material of varying thickness can be processed on such a machine, the lift of the needles has to be adapted to the thickness of the sewing material. The lower point of reversal of each individual needle, wherein the lower thread is fed by the looper, always has to be in the same location in order to obtain a flawless transfer and for producing a uniform and even stitch pattern.

SUMMARY OF THE INVENTION

It is, therefore, an object of the present invention to provide a needle drive by which the lift of the needle can be easily adjusted and adapted to the sewing material to be processed without the lower point of the reversal changing its position due to any change in the lift of the needle.

The foregoing and related objects are achieved by the present invention in which a needle drive for a multi-needle stitching machine is provided with a needle bar supported on vertical guides, by which the needles mounted on the needle bar are drivable. The needle bar of the invention is supported by a pair of elbow joint levers and the elbow joints of the cooperating elbow joint levers are connected with each other by a push rod, which is movable back and forth, transversely, to the direction of the needle lift by a drive.

The interconnection of a pair of elbow lever joints between the needle-holding bar and the suspension, the latter being fixed on the frame, precisely results in an unchanging point of reversal. The lift of the needle can be accurately and precisely adjusted and changed by adjusting the amount of deflection of the elbow joint of the, at least, two elbow joint levers.

In a preferred embodiment of the invention, the push rod connecting the elbow joints with each other is driven by a swash plate drive. Exactly the same deflection of the elbow joints on both sides of the dead position is possible with the swash plate drive.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

The present invention is explained in greater detail, on a multi-needle stitching machine with reference being made to the two preferred embodiments of the invention illustrated in the drawing wherein similar reference numerals denote similar features throughout the several views, in which.

DETAILED DESCRIPTION OF THE DRAWING FIGURES AND PREFERRED EMBODIMENTS

Figure 1:
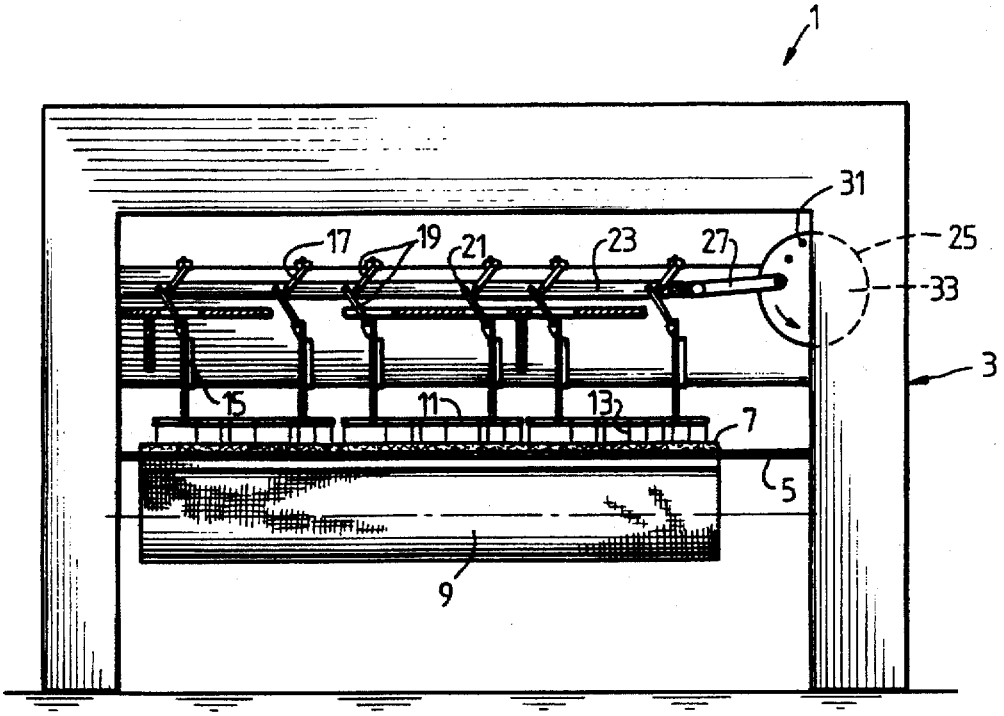
FIG. 1 shows a schematic representation of a multi-needle stitching machine viewed from the front, with a crank drive.

Turning now, in detail, to an analysis of the drawing figures, in FIG. 1, reference numeral 1 denotes a multi-needle stitching machine with a frame 3, a sewing material table 5 for the sewing material 7; the latter being pulled off from a sewing material supply roll 9 in front of the stitching machine 1, across the sewing material table 5. The needle-holding bars 11, which are also referred to as needle arms, with the needles 13, are arranged above the sewing material table 5, and displaceably supported on the vertical guides 15. Each needle bar 13 is connected with the frame 3 by the elbow joint lever pairs 17, which cooperate in pairs. The elbow joint lever pairs 17 comprise two elbow joint levers 19; the elbow joints 21 of which are connected with each other by a push rod 23. The axes of swivel of the elbow joints 21 may be arranged next to each other, or coaxially relative to one another.

In connection with a multi-needle stitching machine 1 of a large width, one single needle bar 11 is replaced by a plurality of needle bars 11, preferably having the same length, such needle bars each being suspended on the frame 3 with one or several elbow joint lever pairs. The push rod 23 may extend across the entire width of the machine 1, or it may comprise a number of part segments each corresponding with the length of the individual needle bars 11.

In FIG. 1, a crank drive 25 is shown on the right side of the multi-needle stitching machine 1; said crank drive being connected with the push rod 23 by means of a crank rod 27. The needle bar 11 is approximately in the highest possible position, i.e., the needles 13 are approximately disposed at their uppermost point of reversal because the elbow levers 19 are deflected sideways.

Figure 2:
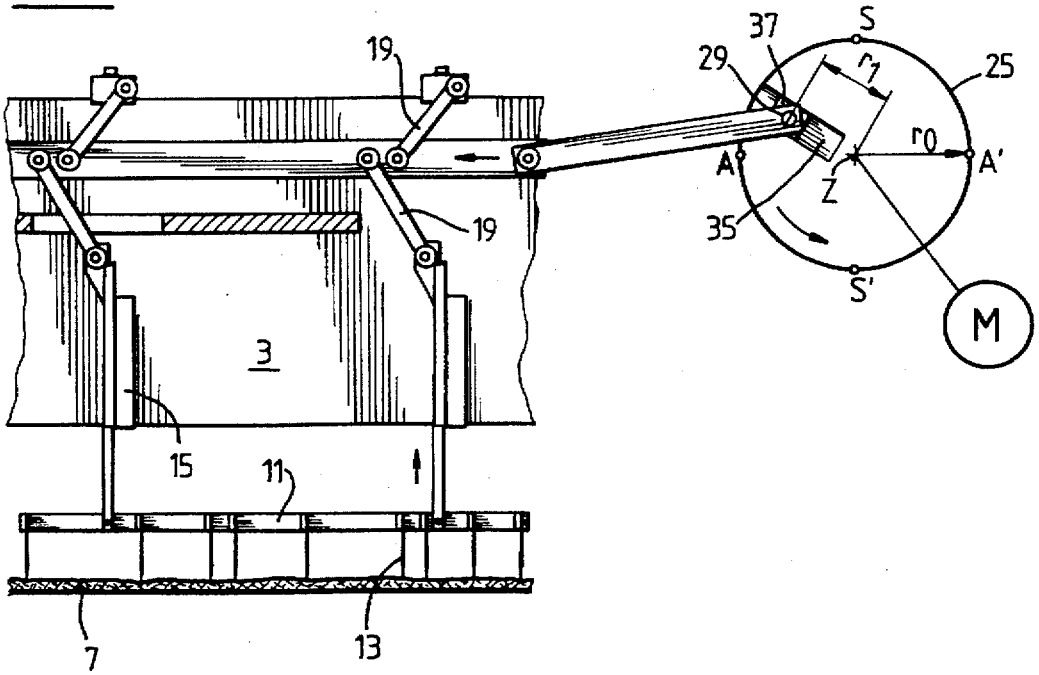
FIGS. 2 and 2A show enlarged cutout representations of a first embodiment of the needle drive with pairs of elbow joint levers with a crank drive (top position)

The function of the needle bar drive, with the crank drive 25, is described in greater detail by reference to FIG. 2. When the crankpin 29 of the crank drive 25 is approximately disposed in the top or bottom apex S, S', the two joint levers 19 are disposed parallel with each other, and the needles 13, or their points, are present at the lower point of reversal. Said point of reversal is reached two times with each complete rotation of the crankpin 29 of the crank drive 25. In this connection, the elbow joint levers 19 are each deflected once to the left side and once to the right side when the crankpin 29 passes through points A, A' disposed in the plane of the axis of rotation of the crank drive 25.

So as to be able to adapt the lift of the needles 13, or of the needle bar 11, to the thickness of the sewing material 7, the crankpin 29 may be mounted on the crank drive 25 with different radial spacings from the axis of rotation Z of crank drive 25. Now if, for example, the crankpin 29 is mounted with the spacing r1 from the axis of rotation Z, the deflection of the elbow joints 21 is correspondingly smaller than with a mounting within the range of the periphery at a radius r0. Consequently, the lift of the needles 13 is smaller, as well, starting from the lower point of reversal. The lower point of reversal of the needles 13 always remains in the same location irrespective of the lift because it is defined only, and solely, by the length of the two elbow joint levers 19. The spacing r of the crankpin 29 from the center Z of the crank drive 25 can be adjusted in different ways. For example, the bores 31 may be provided on a disk 33; such bores being differently spaced from the axis of rotation Z. The bores 31 may have a spacing from the axis of rotation Z conforming to the most frequent applications of the stitching machine 1.

Figure 2A:
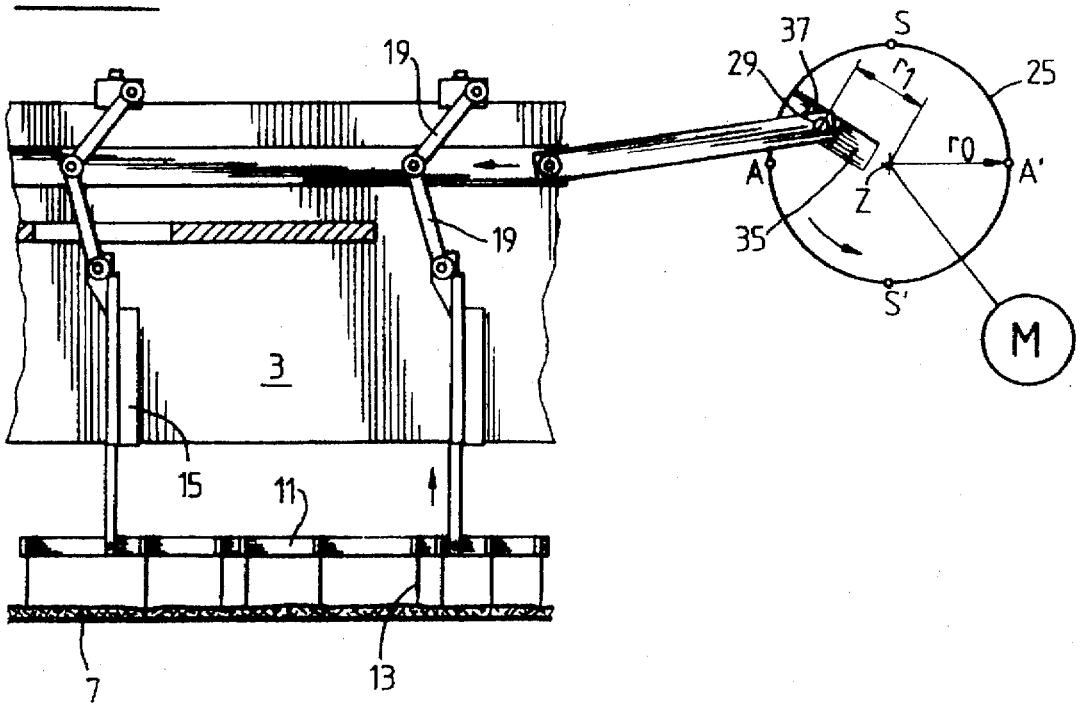

The bores 31 may be disposed in a radially or spirally extending line. A spiral-like design is shown in FIG. 1. Alternatively, instead of making provision for fixed bores 31 in the disk 33, it is also possible to provide the disk of the crank drive 25 with a radially or spirally extending groove 35, in which a displaceable and lockable key 37 is guided; the latter supporting the crankpin 29. If the key 37 is placed very close to the axis of rotation Z, an extremely small lift of the needles 13 is obtained. On the other hand, if said key is displaced up to the peripheral end of the groove 35 and locked there, very thick materials can be processed on the stitching machine 1 because the needle 13 is lifted high above the sewing material table 5. FIG. 2A illustrates an embodiment of the invention wherein the elbow joints on the elbow joint levers are coaxially pivotally connected with the push rod on a common axis.

Figure 3:
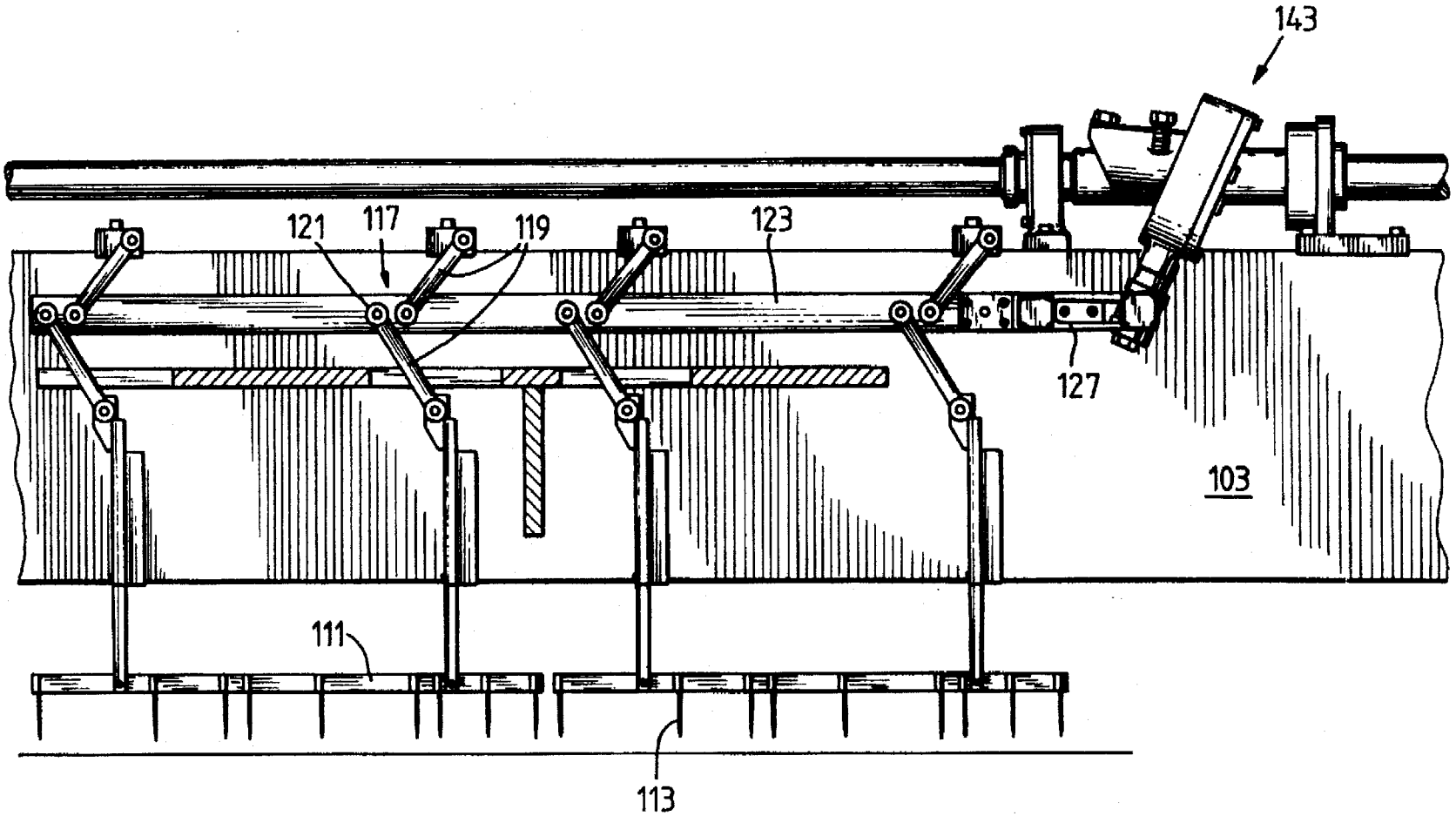
FIG. 3 shows a representation of a needle drive with a swash plate drive.
Figure 4:
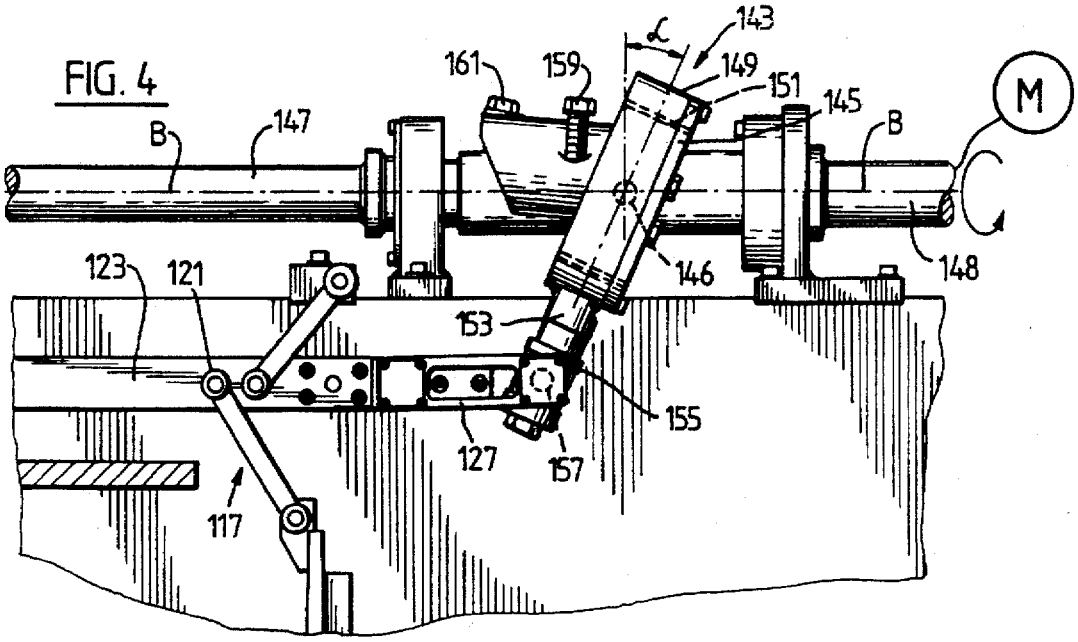
FIG. 4 shows an enlarged representation of the swash plate drive.
Figure 5:
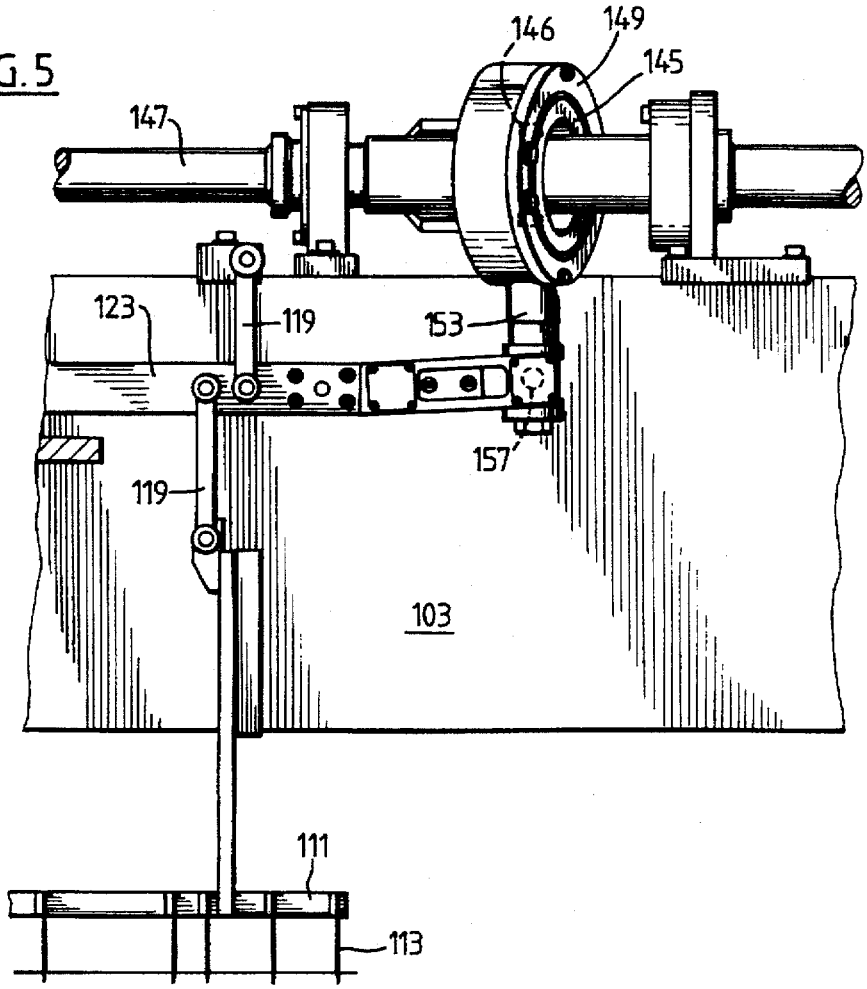
FIG. 5 shows a representation of the swash plate drive in the prick position.

In a second preferred embodiment of the present invention, as illustrated in FIGS. 3–5, the needle bar 111, with needles 113, is mounted on the frame 103, analogous to the first exemplified embodiment. In this second embodiment, too, provision is made for the elbow joint lever arm pairs 117, which are arranged in pairs and comprise the elbow joint levers 119, which are connected with each other on the elbow joints 121 by a push rod 123. The push rod 123, in turn, is coupled with a swash plate drive 143 by a joint part 127. The swash plate drive 143 is explained in greater detail in the following reference to FIGS. 4 and 5.

The swash plate 145 is mounted on a shaft 147, which is driveable by a motor M. In FIG. 4, the axis of the swash plate is disposed at an angle alpha relative to a plane arranged perpendicular to the axis B of the shaft 147. A small angle alpha effects a small—and a large angle alpha—a large lateral deflection of the elbow joint levers 119. However, as with the first exemplified embodiment of the present invention, the lower point of reversal of the needles 113 remains exactly the same.

In the representation of the swash plate drive 143 shown in FIGS. 4 and 5, the end of the push rod 123 is visible on the left side at the bottom, and the shaft 147, at the top. The end of the driving shaft 148 is shown on the right side of the illustration. The swash plate 145 is mounted on the shaft 147 and, at its periphery, has a race 149; the latter being supported by a roller bearing cage 151. A preferably radially disposed driving pin 153 is supported on the periphery of the race 149; said driving pin supporting, at its end 155, a connection bolt 157, by which the joint part 127 can be connected with the race 149. The connection bolt 157 permits absorbing the mutual change in the angles between the axis B and the joint part 127 occurring during the operation of the swash plate 145.

The swash plate 145 is designed ring-shaped and pivotably mounted on the ends of the two axle stubs 146. The axle stubs 146 are fastened on the shaft 147 and extend radially relative to the axis B. The angle alpha of the race 149, and of the swash plate 145 supporting said race, can be adjusted and changed with respect to the axis B of the shaft 147 by means of the two adjusting screws 159, 161.

Alternatively, of course, other means may be used for pivoting the swash plate 145.

The mode of operation of the swash plate drive is explained in greater detail in the following: A 180°-rotation on the shaft 147 results in the connection bolt 157 guiding the push rod 123 from the deflection "right" into the deflection "left." In the course of such displacement, the elbow joints 121 are guided from the position shown in FIGS. 3 and 4, where they are bent to the left (the needles 113 on the needle bar 111 are at their highest point), through the stretched configuration, according to FIG. 5, and then again into the position where they are bent, but, now toward the other side. Following each 90°-rotation of the shaft 147, the dead position is reached, and the needle 113 is at its lower point of reversal. The elbow joint levers 119 are then disposed parallel with each other. As explained above, after the 180°-rotational motion has been completed, the needles 113 have again reached their highest position.

With each further rotation by 180°, the pricking motion of the needle 113 is carried out in the course of the first 90°, and the needle 113 is pulled from the sewing material 107 in the course of the following 90°-angle of rotation. Consequently, one full rotation of the shaft 147 always produces two complete stitches.

For compensating the vibrations of the frame 103 caused by the push rods 123, it is possible to make provision for two swash plates 143 on the shaft 147. Each of said swash plates 143 is connected with the same number of needle bars 111. The first swash plate 143 is arranged in the position shown in FIGS. 3–5; the second swash plate 143 is mounted on the opposite end of the shaft 147, with its geometric position being mirror-symmetric with respect to the first (not shown.) This has the effect that the push rods 111 reciprocate in the opposite sense. Said rods are simultaneously either pushed against each other or apart from one another. The lifts of the needles 113 take place absolutely synchronously irrespective of whether during lifting, some of the elbow joints are deflected to the left and the others to the right, or vice versa. Of course, the pairs of elbow joints or the needle bars are, preferably, associated with the swash plates in exactly the same numbers in each case.

The needle drive according to the present invention can be used for a sewing machine with a plurality of needles, as well.

While only several embodiments of the present invention have been shown and described, it will be obvious to those skilled in the art that many modifications may be made to the present invention without departing from the spirit and scope thereof.

What is claimed is:

1. A needle drive for a multi-needle stitching machine, comprising:

a needle bar;

a plurality of needles mounted on said needle bar with said plurality of needles being drivable;

vertical guides upon which said needle bar is supported;

a drive;

a push rod;

a pair of elbow joint levers supporting said needle bar, with elbow joints of cooperating said elbow joint levers being connected with each other by said push rod, said push rod being movable back and forth transversely to a direction of needle lift by said drive; and, a driving pin of a swash plate drive, for a swash plate, mounted on a shaft, wherein said push rod is articulated with said driving pin.

2. The needle drive for a multi-needle stitching machine according to claim 1, wherein said elbow joints on said elbow joint levers are coaxially pivotally connected with said push rod on a common axle.

3. The needle drive for a multi-needle stitching machine according to claim 1, wherein said elbow joints on said elbow joint levers are pivotally connected with said push rod on separate axles disposed adjacent to one another.

4. The needle drive for a multi-needle stitching machine according to claim 1, wherein said drive includes means for adjusting an amount of deflection of said elbow joints.

5. The needle drive for a multi-needle stitching machine according to claim 1, wherein said drive is a crank drive having a crankpin, with said push rod being articulated with a joint part on said crankpin of said crank drive.

6. The needle drive for a multi-needle stitching machine according to claim 5, wherein said drive includes means for adjusting an amount of deflection of said elbow joints.

7. The needle drive for a multi-needle stitching machine according to claim 6, wherein the amount of deflection of said elbow joints is adjustable by means of radial displacement of said crankpin with respect to an axis of rotation of said crank drive.

8. The needle drive for a multi-needle stitching machine according to claim 1, wherein said drive includes means for adjusting an amount of deflection of said elbow joints.

9. The needle drive for a multi-needle stitching machine according to claim 8, wherein the amount of deflection of said elbow joints is adjustable by means for adjusting an angle of inclination with respect to an axis of said shaft of said swash plate.

10. The needle drive for a multi-needle stitching machine according to claim 1, wherein said swash plate drive comprises said swash plate and a race rotatably supported on said swash plate, so that said driving pin forming a connection with said push rod is fastened on said race.

11. The needle drive for a multi-needle stitching machine according to claim 1, wherein two of said swash plate drives are arranged on said shaft, with each of said swash plate drives being connected with at least one of said push rods.

12. The needle drive for a multi-needle stitching machine according to claim 11, wherein said two of said swash plate drives are mounted on said shaft, disposed mirror-symmetrically relative to one another.

* * * * *